US006672862B2

(12) United States Patent
Neville et al.

(10) Patent No.: US 6,672,862 B2
(45) Date of Patent: Jan. 6, 2004

(54) PREMIX BURNER WITH INTEGRAL MIXERS AND SUPPLEMENTARY BURNER SYSTEM

(75) Inventors: Thomas B. Neville, Cleveland Heights, OH (US); Thomas F. Robertson, Medina Township, OH (US); Brian J. Schmotzer, Cleveland Heights, OH (US)

(73) Assignee: North American Manufacturing Company, Cleveland, OH (US)

( * ) Notice: Subject to any disclaimer, the term of this patent is extended or adjusted under 35 U.S.C. 154(b) by 47 days.

(21) Appl. No.: 09/755,576

(22) Filed: Jan. 5, 2001

(65) Prior Publication Data

US 2001/0026911 A1 Oct. 4, 2001

Related U.S. Application Data

(63) Continuation-in-part of application No. 09/535,342, filed on Mar. 24, 2000, now abandoned.

(51) Int. Cl.[7] ..... F23D 14/58

(52) U.S. Cl. ..... 431/285; 431/353; 431/354; 431/187; 431/116; 431/174

(58) Field of Search ..... 431/285, 9, 353, 431/350, 278, 174, 175, 185, 187, 8, 115, 116, 10, 354

(56) References Cited

U.S. PATENT DOCUMENTS

| | | | | |
|---|---|---|---|---|
| 3,164,200 A | * | 1/1965 | Reed | 431/284 |
| 4,059,385 A | | 11/1977 | Gulitz et al. | 431/12 |
| 4,443,182 A | * | 4/1984 | Wojcieson et al. | 431/187 |
| 4,945,841 A | | 8/1990 | Nakamachi et al. | 431/174 |
| 5,073,105 A | * | 12/1991 | Martin et al. | 431/116 |
| 5,092,761 A | | 3/1992 | Dinicolantonio | 431/115 |
| 5,195,884 A | | 3/1993 | Schwartz et al. | 431/8 |
| 5,201,650 A | | 4/1993 | Johnson | 431/9 |
| 5,238,395 A | * | 8/1993 | Schwartz et al. | 431/115 |
| 5,407,345 A | | 4/1995 | Robertson et al. | 431/115 |
| 5,433,600 A | * | 7/1995 | Jeng et al. | 431/185 |

(List continued on next page.)

FOREIGN PATENT DOCUMENTS

| | | | |
|---|---|---|---|
| DE | 24 49 986 A | * | 10/1975 |
| EP | 0 626 538 A | * | 11/1994 |
| JP | 7-243619 A | * | 9/1995 |

OTHER PUBLICATIONS

Unpublished North American Manufacturing Company Ltd. drawing No. 4–31184, entitled "Burner Assy for 4211–15/X2509 Burner."

Unpublished North American Manufacturing Company Ltd. drawing No. 4–29759, entitled "Radial Gas Connection for 4211–15 LE."

U.S. patent application 09/535,342, filed Mar. 24, 2000, now abandoned.

*Primary Examiner*—Josiah C. Cocks
(74) *Attorney, Agent, or Firm*—Jones Day

(57) ABSTRACT

An apparatus is provided including a furnace structure defining a reaction chamber in which oxidant and fuel are reacted to form combustion products and having an anchor surface having an opening through which the oxidant and fuel are introduced into the reaction chamber. The reaction chamber is configured to recirculate the combustion products back toward the anchor surface. The apparatus also includes an anchor outlet configured to create a layer of combustion products directed along the anchor surface under the influence of the recirculated combustion products. The apparatus further includes a primary outlet configured to direct primary fuel to flow into the reaction chamber through the opening and the layer of combustion products so as to ignite the primary fuel.

17 Claims, 4 Drawing Sheets

U.S. PATENT DOCUMENTS

| | | | | | |
|---|---|---|---|---|---|
| 5,466,148 | A | | 11/1995 | Witteveen | 431/174 |
| 5,498,155 | A | | 3/1996 | Chyou et al. | 431/350 |
| 5,542,840 | A | * | 8/1996 | Surbery et al. | 431/174 |
| 5,554,021 | A | | 9/1996 | Robertson et al. | 431/9 |
| 5,573,396 | A | | 11/1996 | Swanson | 431/187 |
| 5,624,252 | A | | 4/1997 | Charles, Sr. et al. | 431/7 |
| 5,655,903 | A | | 8/1997 | Fischer | 431/353 |
| 5,667,374 | A | | 9/1997 | Nutcher et al. | 431/7 |
| 5,713,206 | A | | 2/1998 | McWhirter et al. | 60/747 |
| 5,730,591 | A | | 3/1998 | Robertson et al. | 432/106 |
| 5,782,627 | A | | 7/1998 | Döbbeling et al. | 431/8 |
| 5,791,892 | A | | 8/1998 | Dobbeling et al. | 431/285 |
| 5,813,846 | A | | 9/1998 | Newby et al. | 431/9 |
| 5,879,148 | A | | 3/1999 | Cheng et al. | 431/9 |
| 5,947,714 | A | | 9/1999 | Dreher | 431/8 |
| 5,984,665 | A | | 11/1999 | Loftus et al. | 431/9 |
| 6,007,325 | A | | 12/1999 | Loftus et al. | 431/9 |
| 6,036,481 | A | | 3/2000 | Legutko et al. | 431/354 |
| 6,062,848 | A | * | 5/2000 | Lifshits | 431/285 |
| 6,098,406 | A | | 8/2000 | Bolis et al. | 431/353 |
| 6,126,439 | A | | 10/2000 | Knöpfel et al. | 431/9 |
| 6,145,501 | A | | 11/2000 | Manohar et al. | 431/170 |
| 6,196,835 | B1 | | 3/2001 | Gutmark et al. | 431/350 |

* cited by examiner

PREMIX BURNER WITH INTEGRAL MIXERS AND SUPPLEMENTARY BURNER SYSTEM

This application is a continuation-in-part of U.S. patent application Ser. No. 09/535,342 filed Mar. 24, 2000, now abandoned.

FIELD OF THE INVENTION

The present invention is directed to the field of premix combustion systems, particularly those of the type with reduced emissions.

BACKGROUND

Premix is obtained through the mixing of fuel and oxidant prior to introducing the premix to the source of ignition stabilization. As the fuel and oxidant content of premix approaches uniformity, i.e. homogeneity, the rate of combustion is primarily determined by the reaction rate of the premix. Premix combustion results in a short flame with rapid energy release, permitting smaller combustion chambers and/or increased burner capacity compared to diffusion combustion.

Premix combustion differs from diffusion combustion in that in diffusion combustion fuel and oxidant are separate until they mix at the flame front. In diffusion combustion, the fuel and oxidant content is less uniform, i.e. less homogeneous, than in premix combustion. In diffusion combustion, the rate of combustion is primarily determined by the mixing rate of the fuel and the oxidant. Because mixing occurs on a time scale that is approximately $10^4$ times longer than reaction rates, diffusion combustion results in a flame that is longer than a premix combustion flame.

"Lean" premix indicates a fuel/oxidant mixture containing more oxidant than the amount required to completely combust the fuel. This can be compared to a "rich" premix that indicates a fuel/oxidant mixture containing less oxidant than what is required to completely combust the fuel. A "lean" premix can be indicated mathematically by stating the mixture has an equivalence ratio of less than one. The equivalence ratio ($\Phi$) is a normalized way of measuring the proportion of an actual fuel and oxidant ratio compared to the fuel and oxidant ratio required for stoichiometric combustion. This is expressed as:

$$\Phi = \frac{(Q_{Fuel} / Q_{Oxidant})\text{Actual}}{(Q_{Fuel} / Q_{Oxidant})\text{Stoichiometric}}$$

where Q represents an amount, or flow rate, of fuel or oxidant.

It is sometimes desirable to control the emissions of nitrogen oxide compounds ($NO_x$) and carbon monoxide (CO). It has been observed that lean premix having an equivalence ratio of $0.55<\Phi<0.65$ (when using natural gas as fuel and air as oxidant) produces very low levels of $NO_x$ and CO. As $\Phi$ approaches 1.0, $NO_x$ increases as flame temperature increases. At stoichiometric combustion ($\Phi$=1.0) fuel and air are in optimum proportion, providing maximum peak flame temperatures. As such, the short, intense premix flame can be hot enough to causing nitrogen and oxygen to react, creating $NO_x$.

While it is sometimes desirable to lower the equivalence ratio to reduce $NO_x$, this can increase CO production. However, as a flame temperature drops in response to a lower equivalence ratio, the flame can become less stable and the flame approaches the lower stability limit. An unstable flame can result in areas of incomplete combustion within the flame, which can produce elevated levels of CO. If the equivalence ratio is lowered further, a lower flammable limit (LFL) is reached, where the heat of combustion is absorbed by the thermal ballast and the combustion reaction cannot be sustained.

SUMMARY OF THE INVENTION

The present invention provides an apparatus including a furnace structure in which premix is reacted to form combustion products including an anchor surface having openings through which the premix is introduced into the furnace structure, an array of at least three premix jets, each configured to introduce a corresponding flow of premix into the furnace structure through a corresponding one of the openings, and a supplementary outlet configured to provide anchor combustion products that ignite each corresponding flow of premix introduced into the furnace structure near the openings. Additionally, the present invention provides that the supplementary outlet is further configured to provide anchor combustion products such that each flow of premix is ignited and the ignition distance from the point of ignition of each flow of premix is equidistant from each corresponding one of the openings.

The present invention also provides an apparatus including a furnace structure defining a reaction chamber in which oxidant and fuel are reacted to form combustion products and having an anchor surface having an opening through which the oxidant and fuel are introduced into the reaction chamber. The reaction chamber is configured to recirculate the combustion products back toward the anchor surface. The apparatus also includes an anchor outlet configured to create a layer of combustion products directed along the anchor surface under the influence of the recirculated combustion products. The apparatus further includes a primary outlet configured to direct primary fuel to flow into the reaction chamber through the opening and the layer of combustion products so as to ignite the primary fuel.

The present invention also provides a method including providing a furnace structure defining a reaction chamber having an anchor surface with an opening through which a primary outlet introduces oxidant and fuel into the reaction chamber. The reaction chamber is configured to recirculate combustion products back toward the anchor surface. The method also includes directing anchor fuel to flow from an anchor fuel inlet into the reaction chamber to create an anchor layer that is directed along the anchor surface by the recirculated combustion products. The method further includes directing the primary fuel to flow from the primary outlet into the reaction chamber through the anchor layer.

DETAILED DESCRIPTION OF PREFERRED EMBODIMENTS

Figure 1:
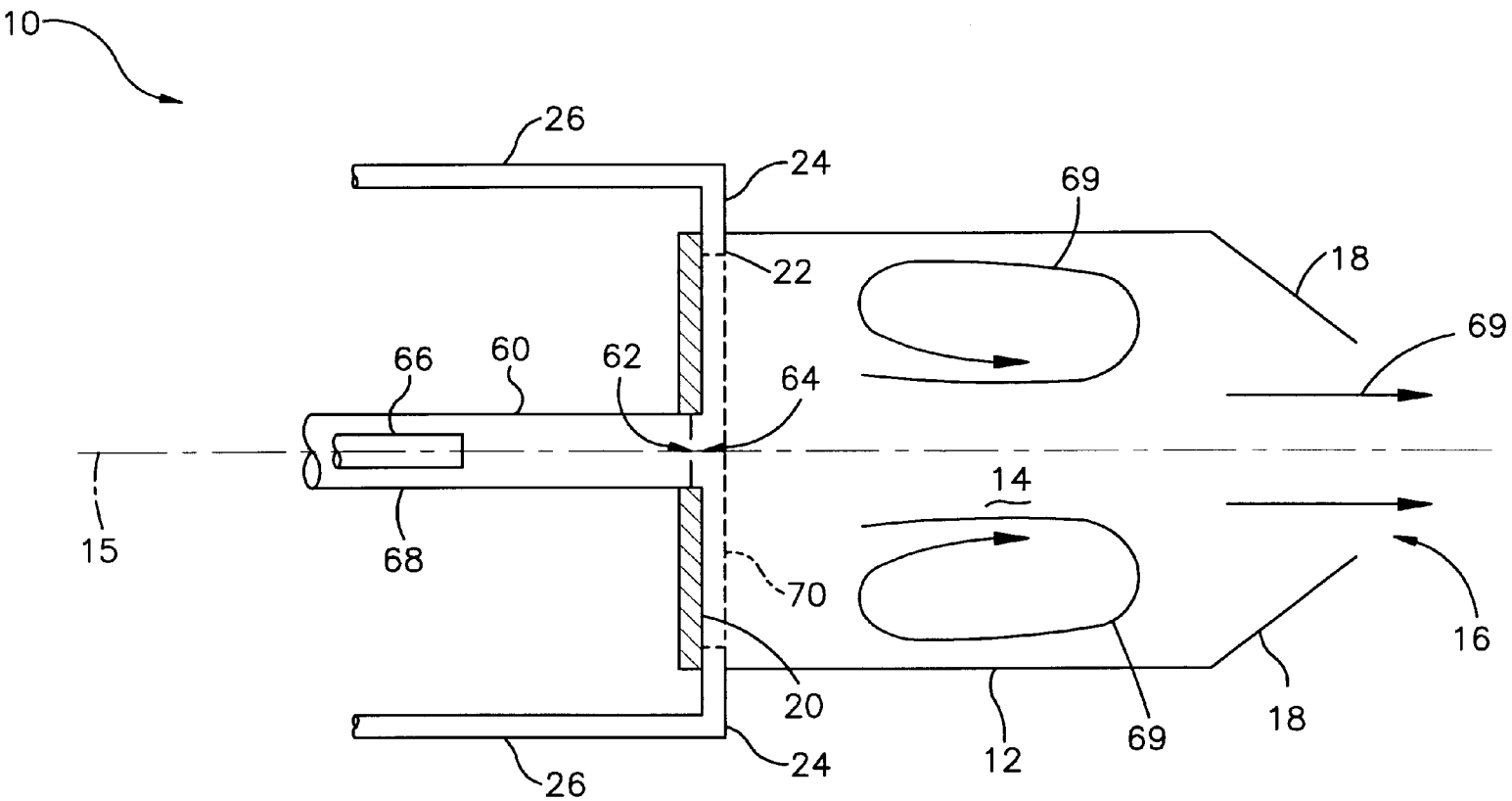
FIG. 1 is a schematic view of an apparatus comprising a first embodiment of the invention.

An apparatus 10 comprising a first embodiment of the invention is shown in FIG. 1. The apparatus 10 is a reduced $NO_x$ emission burner for process heating.

The apparatus 10 includes a furnace structure 12 that defines a reaction chamber 14. The reaction chamber 14 is generally cylindrical and is centered on an axis 15, and is tapered radially inward, i.e. narrows, as it approaches an exit 16 from the reaction chamber 14. The tapering is the result of a choke configuration 18 of the furnace structure 12 centered on the axis 15 and disposed from the rear to the front of the reaction chamber 14. The reaction chamber 14 is configured so that combustion of fuel and oxidant can occur inside the reaction chamber 14. An anchor surface 20 is located at the rear end of the reaction chamber 14, opposite the exit 16. The anchor surface 20 faces forward into the reaction chamber 14 towards the exit 16.

An anchor outlet 22 is located on the periphery of the anchor surface 20. The anchor outlet 22 directs anchor fuel from an anchor fuel structure 24 into the reaction chamber 14. The anchor fuel structure 24 is an inwardly oriented combination premix/diffusion type burner. An anchor fuel line 26 supplies anchor fuel to the anchor fuel structure 24.

A mixing structure 60 is located opposite the exit 16. The mixing structure 60 has a primary outlet 62 that communicates the mixing structure 60 with the reaction chamber 14. The primary outlet 62 directs primary fuel to flow from the mixing structure 60 into the reaction chamber 14 through an opening 64 in the anchor surface 20. A primary fuel line 66 supplies primary fuel to the mixing structure 60. An oxidant line 68 supplies oxidant to the mixing structure 60. The mixing structure 60 is configured to premix primary fuel with the oxidant supplied by the oxidant line 68.

During operation of the apparatus 10, primary fuel and oxidant are each supplied to the mixing structure 60 via the primary fuel line 66 and the oxidant line 68, respectively. The primary fuel and oxidant are mixed in the mixing structure 60 prior to entering the reaction chamber 14 so as to form a premix. The premix is introduced to the reaction chamber 14 through the primary outlet 62. The premix is directed to flow into the reaction chamber 14 through the opening 64 in the anchor surface 20.

An igniter, not shown, initiates combustion of the premix in the reaction chamber 14. The igniter may comprise any suitable device known in the art. The combustion products of the premix are recirculated by the configuration of the reaction chamber 14. More specifically, the tapered choke configuration 18 encourages the recirculation of some of the combustion products. Some of the combustion products recirculate in the reaction chamber 14 and some of the combustion products leave the reaction chamber through the exit 16, as shown by the flow paths 69.

Coinciding with the supply of premix to the reaction chamber 14, anchor fuel is supplied to the anchor fuel structure 24 via the anchor fuel line 26. The anchor fuel structure 24 delivers anchor fuel to the reaction chamber 14 through the anchor outlet 22. The anchor outlet 22 directs the anchor fuel to flow into the reaction chamber 14 across the anchor surface 20.

The anchor fuel is also ignited in the reaction chamber 14. As the recirculating combustion products move toward the rear wall of the reaction chamber 14, i.e., the anchor surface 20, they impinge on the anchor fuel in the reaction chamber 14 and anchor it to the anchor surface 20. Thus, the anchor layer 70 is anchored to the anchor surface 20 under the influence of the recirculating combustion products. In this embodiment, the anchor layer 70 is a radial inward-directed, transverse combustion flow extending from the periphery of the anchor surface 20 over the opening 64, and thus also over the primary outlet 62.

As noted above, the primary outlet 62 is oriented such that primary fuel exiting the primary outlet 62 passes through the opening 64 in the anchor surface 20. Because the anchor layer 70 extends over the primary outlet 62, the primary fuel also passes through the anchor layer 70 upon entering the reaction chamber 14.

The anchor layer 70 of combustion products imparts thermal energy to the premix as the premix flows through the anchor layer 70. That is, as the premix flows through the anchor layer 70, the combustion products from the anchor layer 70, being the first gases the premix flow encounters, are the first gases to be entrained into the flow of primary fuel. As the premix is directed to flow through the anchor layer 70 the ignition distance of the premix is shortened and is anchored to the primary outlet 62. The ignition distance is the distance from the opening to a point where a substantial portion of the premix has begun to chemically react. This ignition anchoring supplies combustion products adjacent to the primary outlet 60. The combustion products can contain radical species and heated gases.

Anchoring the combustion products to the anchor surface 20 in the anchor layer 70 near the primary outlet 60 allows rapid premix ignition. This can be compared to delayed premix ignition that occurs when combustion products are not anchored to the anchor surface 20. Thus, ignition anchoring can provide more rapid completion of combustion to minimize CO production. Also, ignition anchoring can reduce the lower stability limit so that it is closer to the lower flammability limit (LFL). A decreased lower stability limit can result in a decreased equivalence ratio. Ignition anchoring can also decrease the level of cold, non-combusted premix entering the reaction chamber 14.

Figure 2:
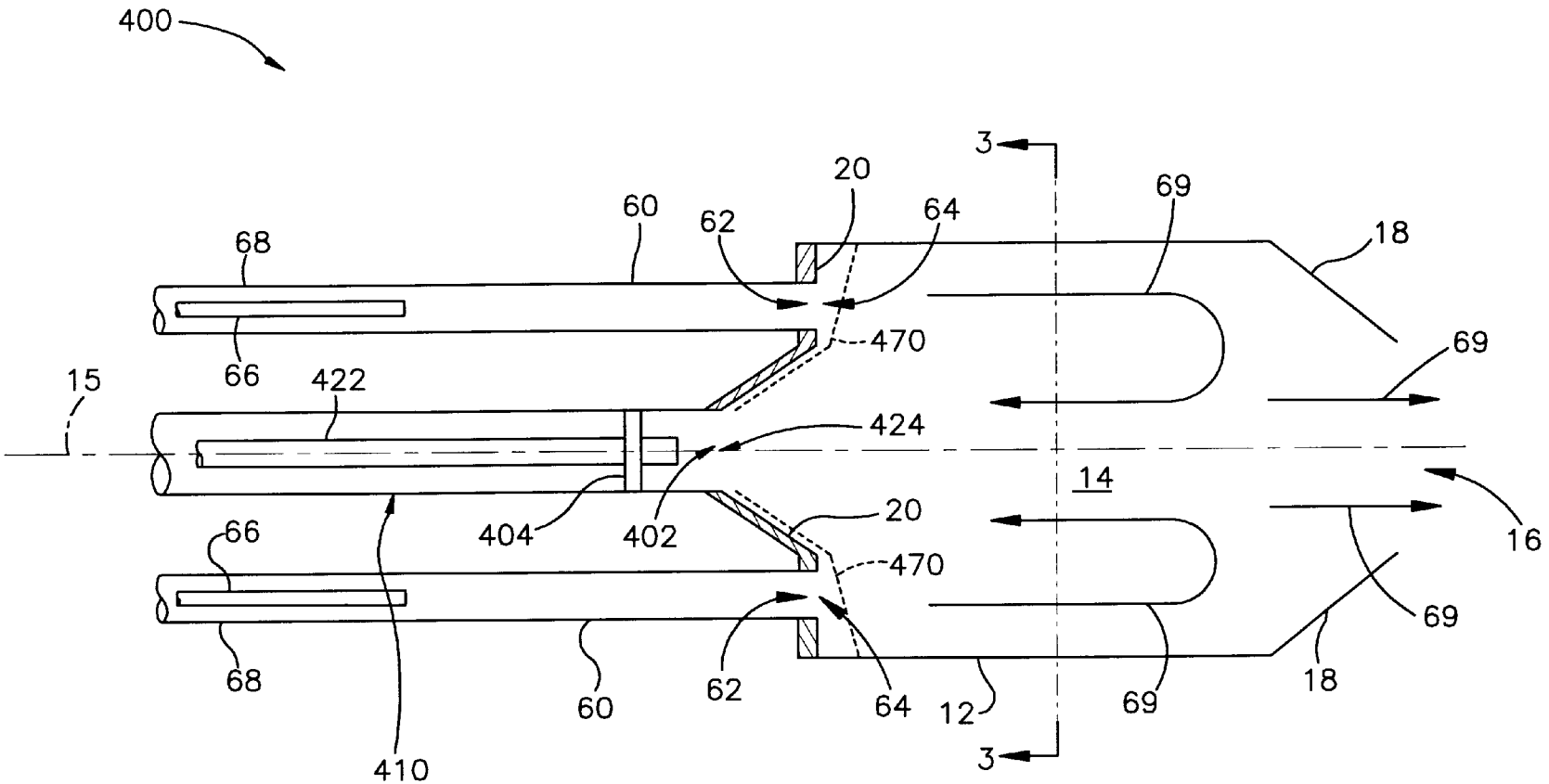
FIG. 2 is a schematic view of an apparatus comprising a second embodiment of the invention.

An apparatus 400 comprising a second embodiment of the invention is shown in FIG. 2. The apparatus 400 has many parts that are substantially the same as corresponding parts of the apparatus 10. This is indicated by the use of the same reference numbers for such corresponding parts in FIGS. 1 and 2. However, the second embodiment of the invention includes an anchor outlet 402. The anchor outlet 402 differs from the embodiment of FIG. 1 in that it is centered on the axis 15 and directs anchor fuel to flow radially outward across the anchor surface 20. Additionally, a mixing structure 404 in an anchor structure 410 is included.

The anchor outlet 402 communicates the anchor structure 410 with the reaction chamber 14 through an opening 424 in the anchor surface 20 and is angled, widening from the opening 424 toward the primary fuel outlets 62. The anchor structure 410 is a radial flame burner. An anchor fuel line 422 supplies the anchor structure 410 with anchor fuel. The mixer structure 404 is a spin plate that induces a swirl. In an alternate embodiment, the anchor outlet 402 is not angled outward, instead, the anchor outlet 402 forms a widening curve from the opening 424 toward the primary fuel outlets 62. The widening curve is configured to direct the anchor fuel towards the primary fuel outlets 62.

Figure 3:
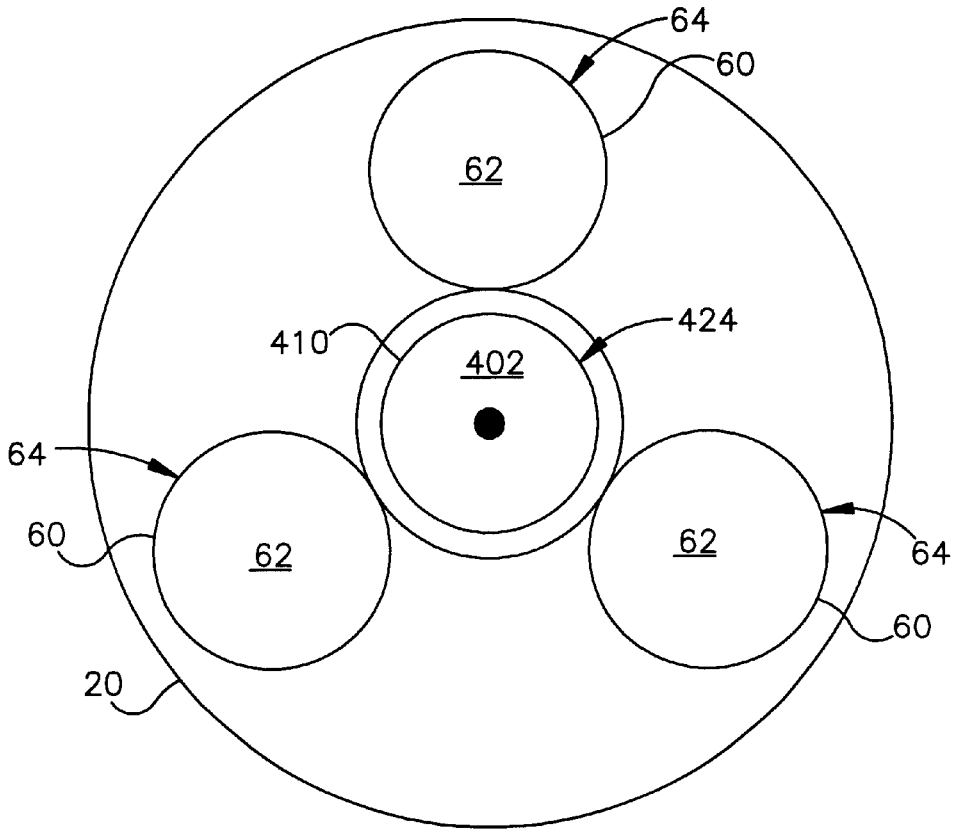
FIG. 3 is a view taken on line 3—3 of FIG. 2.

The mixing structure 60 communicates with the reaction chamber 14 through the primary outlet 62 that is coextensive with the opening 64 in the anchor surface 20. The primary outlet 60 is one of an array of three primary outlets, two of which are shown in FIG. 2. A view along line 4—4 shows the arrangement of the three primary outlets in the array in relation to the anchor outlet 402 in FIG. 3. Primary outlets are located in a circular array extending from the anchor outlet 402 and spaced from the axis 15. The array is arranged so that each primary outlet 60 is equidistant, or substantially so, from the anchor outlet 402.

During operation, primary fuel is supplied to the mixing structure 60 from the primary fuel line 66 and oxidant is supplied to the mixing structure 60 from the oxidant line 68. The mixing structure 60 mixes the primary fuel and oxidant to form premix. Anchor fuel is supplied to the anchor fuel structure 410 through the anchor fuel line 422.

The primary outlet 62 directs premix to flow into the reaction chamber 14 through the opening 64. Simultaneously, the anchor outlet 402 directs anchor fuel to flow into the reaction chamber 14 through the opening 424. In this embodiment, the amount of anchor fuel can be as little as 2% to 5% of the total fuel that is supplied to the reaction chamber 14. Total fuel is the combination of fuel supplied to the reaction chamber in the form of anchor fuel and premix. The mixer structure 404 spins the anchor fuel causing the anchor fuel to spread out, generally in a disk shape overlaying the anchor surface 20.

An igniter, not shown, initiates combustion of the fuel in the reaction chamber 14. The igniter may comprise any suitable device known in the art. The combustion products are recirculated by the configuration of the reaction chamber 14. More specifically, the tapered choke configuration 18 recirculates some of the combustion products, as shown by the flow paths 69. Some of the combustion products recirculate in the reaction chamber 14 and some of the combustion products leave the reaction chamber through the exit 16.

The configuration of the anchor outlet 402 creates a stabilizing recirculating flow pattern during operation of the apparatus 400. Additionally, the angled anchor surface 20 around the anchor outlet 402 also directs the combustion products from the anchor outlet 402 toward the primary outlet 62. The recirculating flow pattern created by the anchor outlet 402 can complement or supplant the recirculation pattern flow paths 69 in the reaction chamber 14. Similar to the recirculating combustion products, the stabilizing recirculating flow pattern in this embodiment also influences the combustion products of the anchor fuel to anchor the combustion of premix entering the reaction chamber 14 to the primary outlet 62. That is, the anchor combustion products are directed toward the primary outlet 62.

The anchor fuel combustion flow spreads, adjacent to the anchor surface 20, radially outward from the anchor outlet 402 in a disk shaped thin layer. The anchor layer 470 overlays the anchor surface 20 and extends to each primary outlet 62. The anchor structure 410 can also act as a pilot for the premix entering the reaction chamber 14.

Because the anchor fuel combustion flow extends to the primary outlet 62, the primary fuel passes through the anchor fuel combustion products upon entering the reaction chamber 14. The anchor layer 470 of combustion products imparts thermal energy to the premix. That is, as the premix flows through the anchor layer 470, the combustion products, being the first gases the premix flow encounters, are the first gases to be entrained into the flow of premix. This results in the ignition distance of the premix being shortened and anchored to the primary outlet 62.

Figure 4:
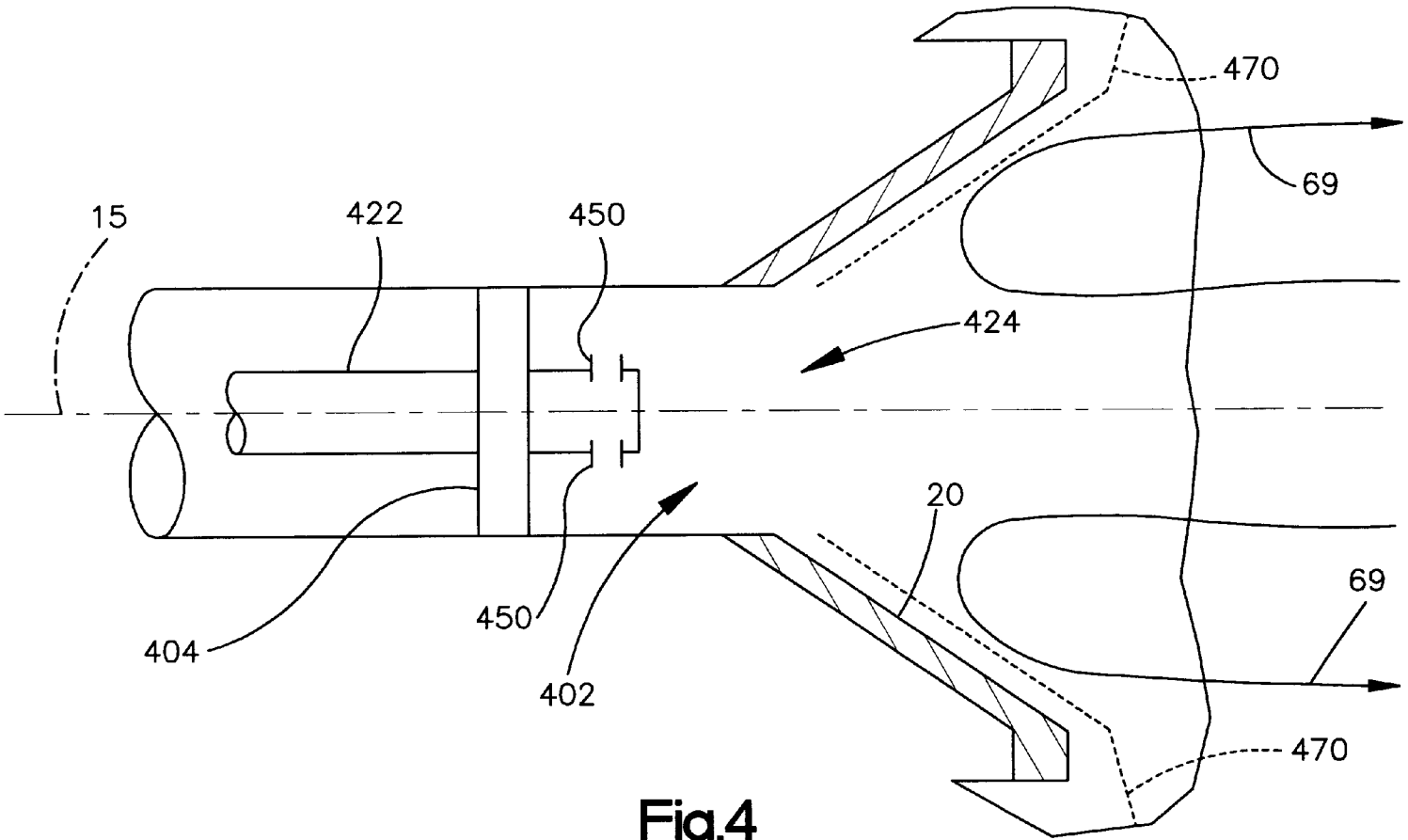
FIG. 4 is an enlarged schematic view of part of the apparatus shown in FIG. 2.

FIG. 4 is an enlarged partial view of the anchor fuel structure 410 of the second embodiment, shown in FIG. 2. The anchor structure 410 shown in FIG. 4 injects an amount of supplemental fuel from a diffusion outlet 450 into the reaction chamber 14. The injected supplementary fuel depresses the lower stability limit of the oxidant/fuel mixture in the reaction chamber 14 so that it approaches the lower flammable limit (LFL).

As will be appreciated, the invention is capable of other and different embodiments and its several embodiments are capable of modifications in various respects, all without departing from the invention. Accordingly, the drawings and description are to be regarded as illustrative in nature and not restrictive.

What is claimed is:

1. An apparatus for use with a furnace structure defining a reaction chamber with an entrance end, an exit end, and a choke configuration to direct recirculating combustion products from said exit end back toward said entrance end, said apparatus comprising:

an anchor surface configured to face into the reaction chamber at the entrance end, said anchor surface having an inner opening on an axis, and radially outer openings in an array extending around said axis;

a corresponding array of mixing structures, each of which comprises an oxidant supply line and a fuel supply line that together communicate with a respective one of said outer openings such that each of said mixing structures is configured to direct unignited premix into the reaction chamber through the respective outer opening; and an anchor structure including a radial flame burner arranged to fire into the reaction chamber through said inner opening, whereby combustion products can spread radially outward from said inner opening in an anchor layer that overlays said anchor surface under the influence of the recirculating combustion products, and can thus overlay said outer openings to minimize the ignition distance for the premix to be ignited upon moving from said outer openings directly into the anchor layer without delay.

2. An apparatus as defined in claim 1 wherein said radial flame burner has an anchor fuel line with a diffusion outlet configured to emit fuel in only radial directions.

3. An apparatus as defined in claim 1 wherein said radial flame burner has a mixing structure.

4. An apparatus as defined in claim 3 wherein said mixing structure is a spin plate for inducing a swirl in the anchor layer of combustion products.

5. An apparatus as defined in claim 1 wherein said anchor surface has a conical surface portion that widens radially outward of said inner opening.

6. An apparatus as defined in claim 5 wherein said anchor surface further has a planar surface portion that extends radially outward of said conical surface portion, with said array of radially outer openings located at said planar surface portion.

7. An apparatus as defined in claim 6 wherein said conical portion of said anchor surface is adjacent to said inner opening, and said planar portion is adjacent to said conical portion.

8. An apparatus for use with a furnace structure defining a reaction chamber with an entrance end, an exit end, and a choke configuration to direct recirculating combustion products from said exit end back toward said entrance end, said apparatus comprising:

an anchor surface configured to face into the reaction chamber at the entrance end, said anchor surface having an inner opening on an axis, and radially outer openings in an array extending around said axis;

a corresponding array of mixing structures, each of which comprises an oxidant supply line and a fuel supply line that together communicate with a respective one of said outer openings such that each of said mixing structures is configured to direct unignited premix into the reaction chamber through the respective outer opening; and an anchor burner with a mixing structure arranged to fire into the reaction chamber through said inner opening, whereby combustion products can spread radially outward from said inner opening in an anchor layer that overlays said anchor surface under the influence of the recirculating combustion products, and can thus overlay said outer openings to minimize the ignition distance for the premix to be ignited upon moving from said outer openings directly into the anchor layer without delay.

9. An apparatus as defined in claim 7 wherein said mixing structure is a spin plate for inducing a swirl in the anchor layer of combustion products.

10. An apparatus as defined in claim 7 wherein said burner has an anchor fuel line with a diffusion outlet configured to emit fuel in only radial directions.

11. An apparatus as defined in claim 7 wherein said anchor surface has a conical surface portion that widens radially outward of said inner opening.

12. An apparatus as defined in claim 11 wherein said anchor surface further has a planar surface portion that extends radially outward of said conical surface portion, with said array of radially outer openings located at said planar surface portion.

13. An apparatus as defined in claim 12 wherein said conical portion of said anchor surface is adjacent to said inner opening, and said planar portion is adjacent to said conical portion.

14. An apparatus for use with a furnace structure defining a reaction chamber with an entrance end, an exit end, and a choke configuration to direct recirculating combustion products from said exit end back toward said entrance end, said apparatus comprising:

an anchor surface configured to face into the reaction chamber at the entrance end, said anchor surface having an inner opening on an axis, a conical surface portion that widens radially outward of said inner opening, and a planar surface portion that extends radially outward of said conical surface portion, said planar surface portion having a plurality of outer openings;

a plurality of mixing structures, each of which comprises an oxidant supply line and a fuel supply line that together communicate with a respective one of said outer openings such that each of said mixing structures is configured to direct unignited premix into the reaction chamber through the respective outer opening; and an anchor burner arranged to fire into the reaction chamber through said inner opening, whereby combustion products can swirl from said inner opening in an anchor layer that overlays said conical and planar portions of said anchor surface under the influence of the recirculating combustion products, and can thus overlay said outer openings to minimize the ignition distance for said premix to be ignited upon moving from said outer openings directly into said anchor layer without delay.

15. An apparatus as defined in claim 14 wherein said conical portion of said anchor surface is adjacent to said inner opening, and said planar portion is adjacent to said conical portion.

16. An apparatus as defined in claim 14 wherein said burner has a mixing structure in the form of a spin plate for inducing a swirl in the anchor layer of combustion products.

17. An apparatus as defined in claim 14 wherein said burner has an anchor fuel line with a diffusion outlet configured to emit fuel in only radial directions.

* * * * *